United States Patent [19]

Yang

[11] Patent Number: 4,876,759

[45] Date of Patent: Oct. 31, 1989

[54] BRIDGE EXPANSION JOINT

[76] Inventor: Jesse S. Yang, No. 28, Sec. 2, Chung Cheng Rd., Shih Lin, Taipei, Taiwan

[21] Appl. No.: 207,111

[22] Filed: Jun. 14, 1988

[51] Int. Cl.[4] ..... E01D 19/06

[52] U.S. Cl. ..... 14/16.5; 404/54

[58] Field of Search ..... 404/47, 49, 53, 54, 404/56, 67–69; 14/16.1, 16.5; 52/396, 573, 167

[56] References Cited

U.S. PATENT DOCUMENTS

| | | | |
|---|---|---|---|
| 3,430,544 | 3/1969 | Berks | 14/16.5 X |
| 3,484,882 | 12/1969 | Blanschette | 14/16.1 |
| 3,604,322 | 9/1971 | Koster | 14/16.5 X |
| 3,779,660 | 12/1973 | McGeary et al. | 404/69 |
| 4,111,582 | 9/1978 | Tippett | 14/16.5 X |
| 4,553,792 | 11/1985 | Reeve | 52/167 X |
| 4,653,956 | 3/1987 | Lang | 404/53 X |

*Primary Examiner*—Jerome W. Massie, IV
*Assistant Examiner*—Matthew Smith
*Attorney, Agent, or Firm*—Fleit, Jacobson, Cohn, Price, Holman & Stern

[57] ABSTRACT

An expansion joint for buried inner placement over an expansion seam under a bridge roadway includes padding sheets fixed to the bridge deck on either side of the expansion seam in the deck. Padding slats are fixed to the bridge deck outboard of the padding sheets. A steel plate is superimposed above the padding sheets and padding slats and is provided on its underside with sliding pads and padding slats corresponding to the padding sheets and padding slats on the bridge deck. Rivets are anchored in the deck and accommodated in expansion slots in the sliding pads and steel plate. The rivets and slots are covered by guard covers. The joint is intended to be paved over.

1 Claim, 2 Drawing Sheets

BRIDGE EXPANSION JOINT

BACKGROUND OF THE INVENTION

1. Field of the Invention

The present invention is for a kind of expansion joint to be placed inside a road bridge between the bridge's members with their flanges in upper section to be structured in viaducts. Then the bridge deck is paved with consecutive floors to attain the object that the bridge surface keeps the integrity of non-opening type expansion joints and its appearance is enhanced.

2. Description of the Background Art

The conventional bridge undergoes the changes of expansion and contraction due to factors such as (1) change of the temperature, (2) potential alteration of cement concrete, (3) dry shrinkage of the concrete and (4) the loading of traffic passing over the bridge leading to the displacement of its structure. Hence it is necessary to install elastic joints of the proper widths in plurality to prevent disfigurement of the bridge.

In the bridge structure, the elastic joints in the road bridge are the most easy targets for damage as they receive repeated impacts and pressure caused by the passing cars with heavy loads. No matter what the structure and construction of the bridge are, the first problem the bridge faces when it is opened to the general public for traffic will be the issue of the expansion joints' damage. The following are the main causes of damage to the bridge's elastic joints:

(1) The steel plates on the bridge deck are unable to extend from their anchor position for expansion or contraction in order to form an integrated body.

(2) The expansion joints and concrete road surface or bituminous concrete road surface can not maintain an even and smooth surface.

(3) Grouting has not been filled into the place between the expansion joints and concrete in a firm manner with cavities, foam or even honeycombs.

(4) The welding operation on the fixed rods of the expansion joints was not proper or the rubber was poorly glued to the steel plates.

(5) The expansion joints show open gaps on the road floors so that the floors are not interconnected. The wider the gaps on the bridge floors are, the more impacts and pressures are received by the bridge due to the loads of the passing cars.

The above causes made the expansion joints become impaired in the short period from one to three years after the road bridge was opened to traffic to the extent that the safety of transportation and maintenance of the bridge were adversely affected.

Generally the road bridge is made up of steel beams, concrete reinforced with steel ribs, and the bridge decks formed by the installation of expansion joints and bituminous concrete elastomer on the upper flanges of the members of the bridge surface, wherein the expansion joints pass the bituminous concrete elastomers on the bridge surface via steel reinforced concrete from the steel beams of the members of the bridge surface open framework. But the disfigurement of the bridge surface is caused mainly by the influence of temperature, stresses and loads, etc., so as to produce the changes in expansion and contraction. The bituminous concrete elastomers on the upper flanges of the bridge surface are the same as the bituminous concrete road surface of the ordinary highway, which do not produce the expansion or contraction in the formation of local extrusion, folding or distortion. Theoretically speaking, the bituminous concrete elastomers on the road bridge can be paved consecutively without any interruption. That means the expansion joints on the road bridge may be installed between the steel beams on the members of the road bridge and the structures of steel reinforced concrete. There is no necessity for the joints to penetrate the elastomer of the bituminous concrete and protrude outside of the road bridge surface. Only the proper installation is added to the upper flange of the expansion joints and thus the elastomers of the bituminous concrete on the bridge floor can be paved consecutively and continuously to form the bridge surface without revealing the expansion joints buried beneath it. Hence the present invention may resolve the problem of discontinuous bridge floors caused by the open type joints. Meanwhile the other problems such as the uneveness of the car's travel thereon, noise, damage to the bridge and its maintenance can also be resolved to some extent.

U.S. patent application No. 362,972 U.S. Pat No. 3,838,931 entitled "Elastic Road Bridge Joint", appl. No. 828,813, U.S. Pat No. 4,111,582 entitled "Expansion Joint" and appl. No. 122,920, U.S. Pat No. 4,279,533 entitled "Roadway Expansion Joint" showed their methods with some characteristics but they are not so convenient as the feature disclosed in the present invention.

In view of the above, the present invention provides inner placement type (buried type) expansion joints by means of a structure of viaducts installed on the upper flanges of the expansion joints on the deck of the bridge surface so that the bituminous concrete elastomers on the bridge floor can be paved up in a consecutive and continuous manner so that the expansion joints are invisible on the bridge floor. Thus the problems arising from the open type expansion joints on the bridge floor such as the difficulty of bridge engineering, the safety in the use of the bridge and the maintenance issues, etc. can be resolved to some extent.

The present invention is a kind of expansion joint to be placed inside the road bridge between the bridge's members with their flanges in upper section to be structured in viaducts. Then the bridge deck is paved consecutively with floors to attain the object that the bridge surface maintains the integrity of non-opening type expansion joints and its appearance is enhanced.

BRIEF DESCRIPTION OF THE DRAWINGS

In conjunction with the attached drawings of a practical example, the detailed embodiment are described as follows.

DETAILED DESCRIPTION OF THE PREFERRED EMBODIMENT

Figure 1:
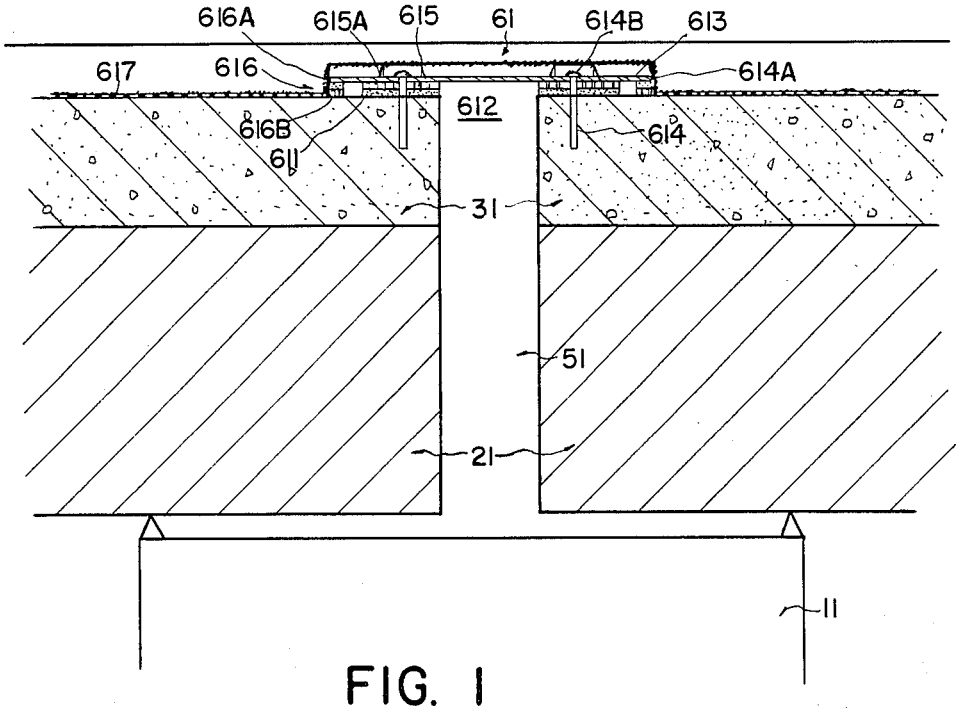
FIG. 1 is a partial cross section practical example of the present invention.
Figure 2:
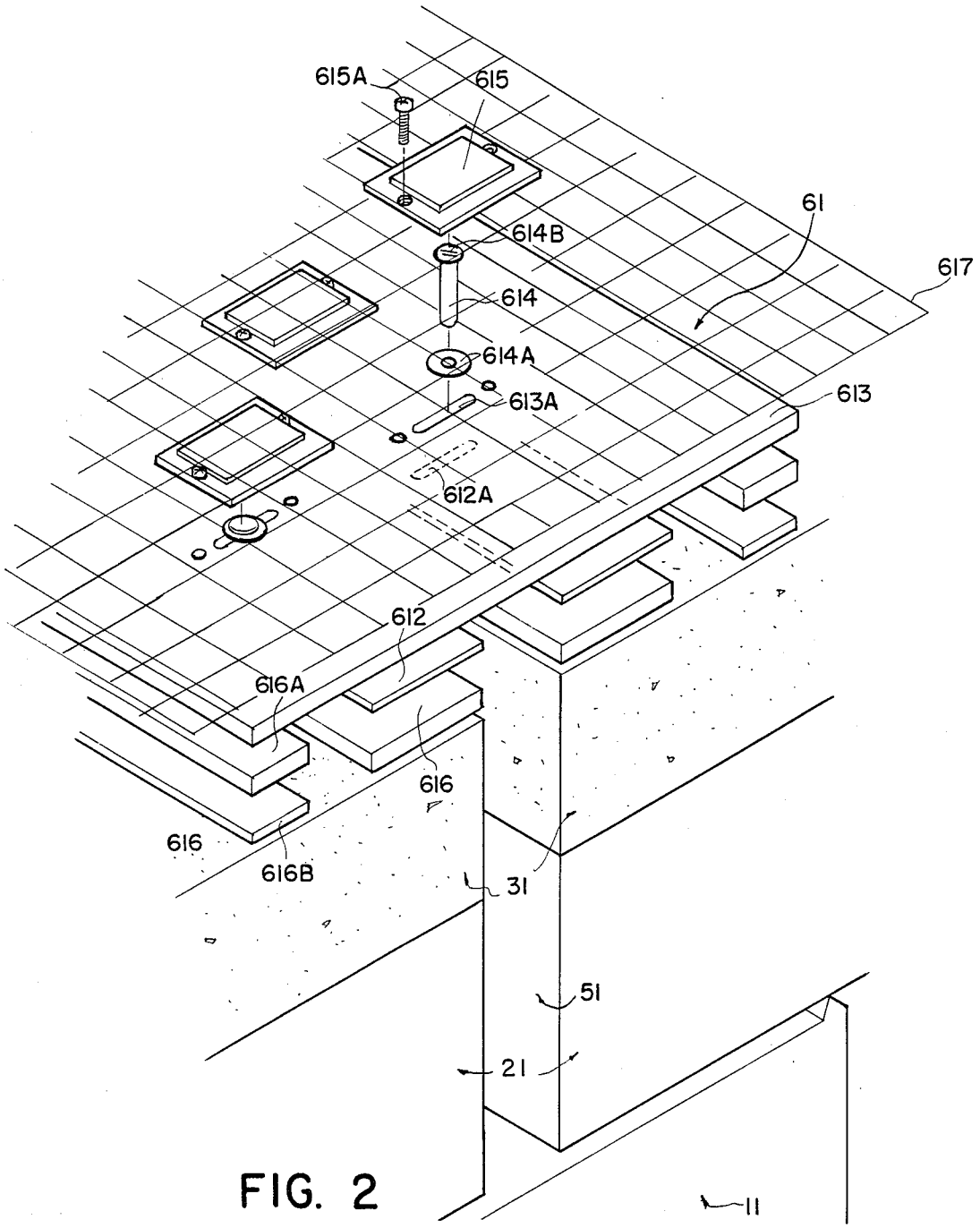
FIG. 2 is a partial diagram in parts of the practical example of the present invention.

As shown in FIGS. 1 and 2, the inner placement type expansion joint on the bridge in the present invention has a mounting device 61 constructed on the upper flanges of the expansion seams 51 reserved beforehand between the steel beams 21 on the floor of the bridge and the steel reinforced concrete ground layer 31 so that the bituminous concrete can be paved on the floor of the bridge continuously and consecutively and so that the bridge floor will not reveal the expansion seams 51, i.e. reveal any interruption.

The mounting device 61 in the present invention is mainly composed of padded sheets 611, sliding pads 612, mounting steel plate 613, rivets 614, guard covers 615 and padding slats 616, and steel iron wire 617 as the main members, wherein the padded sheets 611 are made up of synthetic rubber or plastic as raw materials in proper width and length for use.

The sliding pads 612 are installed with movable rivet holes of rectangular or oval shape provided therein. The sliding pads 612 are made up of solid and smooth board with the same specifications as the padded sheets, wherein the mounted structure of the steel plates 613 are slightly wider than the expansion seam 51 and the sum of the widths of two sliding pads 612 (or two padded sheets 611) and two padding slats 616. Hence when the structural steel plates 613 are mounted on the steel reinforced concrete ground layer 31 on both sides of the seam, the upper flanges of which are glued to the expansion joint 51 containing the padded sheet 611 and sliding pads 612, the proper expansion or contraction gaps are still left between the padding slats 616 on the lower flanges of its two sides and padded sheets 611 and sliding pads. The structural steel plates 613 are intended to be superimposed over the two sides of the sliding pads 612 and include a plurality of movable rivet holes 612A coresponding to the multiple movable rivet holes of the same shape in plates 613.

The base face of the guard cover 615 is slightly larger in size and is able to cover the movable rivet hole 615A. The padding slat 616 and padded sheet 611 are made up of the same material, synthetic rubber or plastic, in the same thickness tailored to the upper slat-like shapes, which are glued to the lower part 616B of the padding slat made up of the same material in a firm and smooth block. The two sides of the lower flanges of the structural steel plate 613 are glued to the padding slats. The upper part 616A of the padding slat is glued to the lower flange of the structural steel plate 613.

As shown in the drawing, the mounted structure installation in the present invention is placed on the upper flange of the expansion seams left beforehand between the steel beams 21 on the base part of the bridge face and the steel reinforced concrete ground layer 31, wherein the padded sheets 611 are respectively glued to the structural steel plate 613 containing the padding slats 616 on the lower flange at both sides of the expansion joint comprising the padded sheet 611 and sliding pad 612 and that also makes the movable rivet holes 613A in both sides of the structural steel plate 613 correspond in location with the movable rivet holes 612A in the sliding pad 612. The rivet 614 threads through a wide edge ring washer 614A and the movable rivet hole 613A of the structural steel plate 613 and the movable rivet hole 612A in the sliding pad 612. Rivet 614 pierces the padded sheet 611 and anchors within the steel reinforced concrete ground layer 31 on both sides of the expansion gap 51. Then the guard covers 615 respectively cap each movable rivet hole 613A of the mounting steel plate 613. The iron wire screen 617 is paved on the mounting steel plate 613. The iron wire screen 617 extends from the forward and rear sections of the mounting steel plate 613 in proper lengths and the extending portions are paved on the steel reinforced concrete ground layer 31 in order to increase the adhesive strength of bituminous concrete ground layer 41 on the peripheral flanges of the mounting steel plate 613. The width of the steel wire screen 617 is the same as that of the bridge road surface while its length is twice that of the mounting steel plate or more. In the present invention, the iron wire screen 617 takes the form of strands of steel fixed by electric welding, but the material of the iron wire screen may be replaced by other kinds of screen with the same function.

When the temperature or pressures, etc., of various kinds of factors influence the expansion or contraction of the bridge, the steel reinforced concrete ground layer 31 of the bridge surface moves the padded sheet 611 on its upper flange along with the sliding pad 612 and rivets 614 fixed thereon toward the direction of expansion gap 51 or toward the other direction from the expansion gap 51 in displacement due to the expansion or contraction of the steel concrete ground layer 31. The nut 614B is mounted on the upper flange of the movable rivet hole 613A because its lower flange is padded with a wide edge padded ringwasher 614A. The lower flange of guard cover 615 and its upper flange constitutes have a space therebetween for movement rivet 614 freely between the rivet holes 613A and 612A along with the expansion or contraction of the steel ribbed concrete ground layer 31. The movable rivet holes 613A and 612A correspond with the mounting steel plate 613 and sliding pad 612. The padded sheet 611 and sliding pad 612 which are glued together can move in the gap reserved beforehand between the padding slats 616 on the both sides of mounting steel plate 613 at the lower flange so that the expansion or contraction of the expansion joint on the bridge surface does not affect the bituminous concrete ground layer 41 paved on the upper flange. No mound or sunken land will occur in local places and the bridge surface will be maintained in a flat and even manner for a long time.

After every expansion joint on the bridge surface is provided with the mounting structure 61, the surface of the bridge is continuously paved with the bituminous concrete ground layer 41 (or other material) so that the conventional open type expansion joints may be buried beneath the bridge surface's bituminous concrete ground layer 41 to attain the condition of integrity of the bridge surface.

The advantages of the present invention are as follows:

(1) The elimination of fixation devices for the protection of expansion joints required in the conventional road bridge expansion joints of the open type.

(2) To make the road surfaces of the highway and bridge flat and even in uniformity so that cars run thereover steadily and in a safer manner.

(3) Total elimination of the noises and damage caused by the conventional open type expansion joints on the ordinary road bridges where the repeated impacts and stresses are produced by the running loaded cars.

I claim:

1. In a road bridge having a bridge deck including a reinforced concrete ground deck layer provided with an open expansion seam therein and with an upper surface of the ground deck being paved thereover by a road surface pavement, an expansion joint for buried inner placement below the road surface pavement in the expansion seam, the expansion joint comprising:

a pair of padded sheets fixed to the upper surface of the ground deck adjacent respective edges of the expansion seam;

a pair of padding slats fixed to the upper surface of the ground deck and spaced respectively outboard of padded sheets with respect to the expansion seam;

a steel plate superimposed over the padded sheets and padding slats on both sides of the expansion seam; the steel plate spanning the expansion seam;

a pair of sliding pads respectively fixed to an underside of the steel plate at respective locations thereof overlying and corresponding with the padded sheets fixed to the ground deck;

a second pair of padding slats respectively fixed to the underside of the steel plate at respective locations thereof overlying and corresponding with the first pair of padding slats fixed to the ground deck;

a plurality of rivets anchored in the ground deck on respective sides of the expansion seam, said rivets piercing the padded sheets and passing upwardly through expansion slots provided in the sliding pads and the steel plate, said rivets having flanged heads extending above an upper surface of the steel plate, wide edge ring washers being inserted between the upper surface of the steel plate and the flanged heads of the rivets;

a guard cover mounted on the steel plate over each rivet, each guard cover covering a respective expansion slot in the steel plate and accommodating the head of the rivet in said expansion slot; and a wire screen extending outwardly from edges of the steel plate for receiving a road paving material layer.

* * * * *